US005483770A

United States Patent [19]

Marinoni

[11] Patent Number: 5,483,770

[45] Date of Patent: Jan. 16, 1996

[54] DOOR OR WINDOW MOUNTINGS

[75] Inventor: Mario Marinoni, Magenta, Italy

[73] Assignee: Societa Italiana Progetti S.r.l., Magenta, Italy

[21] Appl. No.: 345,487

[22] Filed: Nov. 28, 1994

[30] Foreign Application Priority Data

Nov. 29, 1993 [DE] Germany ..... 9318246 U

[51] Int. Cl.[6] ..... E05D 7/08

[52] U.S. Cl. ..... 49/388; 16/229; 16/238; 16/378

[58] Field of Search ..... 49/388, 390; 160/206, 160/213; 16/238, 229, 378, 237

[56] References Cited

U.S. PATENT DOCUMENTS

| | | | |
|---|---|---|---|
| 982,160 | 1/1911 | Regan | 16/229 X |
| 2,657,421 | 11/1953 | Polson | 16/238 |
| 2,933,756 | 4/1960 | Muessel | 16/229 |
| 3,325,942 | 6/1967 | Bejarano | 49/388 X |
| 3,396,490 | 8/1968 | Dukas | 49/388 X |
| 4,620,392 | 11/1986 | Kerpers et al. | 49/388 |
| 4,646,472 | 3/1987 | Sugawara | 49/388 X |
| 4,815,162 | 3/1989 | McAteer | 49/388 X |

*Primary Examiner*—Philip C. Kannan
*Attorney, Agent, or Firm*—Thomas K. Ziegler

[57] ABSTRACT

Door or window mountings with a first mounting member (2) having a pivot pin (1), said first mounting member being formed as an insert member being fixable within a U-shaped rail (5), or a recess etc.; and with a second mounting member (4), which is formed as a bearing bushing (3) with a fixing panel (8) on the side pointing in the direction of the pivot pin (1) and accommodating this pivot pin (1), wherein the pivot pin (1) is slideable in axial direction within a receiving bore in the insert member and the insert member comprises a lateral elongated hole (10) along the pivot pin (1), a fixing screw (11) extending through said elongated hole being screwed therethrough into the pivot pin (1) which is fixable with regard to the insert member by means of said fixing screw. The insert member comprises a slideway (6) being fixable with regard to the U-shaped rail (5) etc., and the slide member (7) accommodating the pivot pin (1) is guided in such a manner that it is adjustable by means of a regulating screw (12). By means of the invention a door or window mounting is created by means of which fixing the respective mounting member at the door or window frame is possible without problems, no matter which material is used for the door or window frame.

4 Claims, 3 Drawing Sheets

DOOR OR WINDOW MOUNTINGS

The invention relates to door or window mountings with a first mounting member having a pivot pin, said first mounting member being formed as an insert member being fixable within a U-shaped rail, or a recess etc.; and with a second mounting member, which is formed as a bearing bushing with a fixing panel on the side pointing in the direction of the pivot pin and accommodating this pivot pin, wherein the pivot pin is slideable in axial direction within a receiving bore in the insert member and the insert member comprises a lateral elongated hole along the pivot pin, a fixing screw extending through said elongated hole being screwed therethrough into the pivot pin which is fixable with regard to the insert member by means of said fixing screw.

Although preferably the mounting is provided for frameless, hardened all-glass doors, it may also be used for other doors or windows, for instance wooden, metal or plastic doors and windows. For frameless all-glass doors also a U-shaped rail being open towards the upper side maybe provided at the upper rim of the door pane, into which the insert member is insertable and fixable therein. For wooden, metal and plastic doors and windows instead of U-shaped rail also a recess within the door or window-pane rim maybe provided, in which the insert member is accommodated.

In the case of known door mountings as mentioned at the outset, the bearing bushing is formed in the insert member, where on the other side the pivot pin is provided at the other mounting member which is mounted to the door frame, said pivot pin being accommodated in the other mounting member within a slotted cylinder in such a manner that it is moveable. The pivot pin is engaged by an adjusting lever having two arms, the other arm of which being engaged by an adjusting screw by means of which the pivot pin may be withdrawn for mounting the door pane into the mounting member and after inserting the door pane be drawn out of the mounting member again in such a manner that the pivot pin then engages the bearing bushing from the upper side. For such a construction it is necessary that the door frame comprises a recess of an appropriate size and with a rectangular shape for accommodating the lever mechanism, said recess having to be formed within the door frame. However, in particular this is a problem if the material used for the door frame is very hard or brittle as for instance marble, granite, concrete, steel and so on.

It is an object of the invention to create a door or window mounting by means of which fixing the respective mounting member at the door or window frame is possible without problems, no matter which material is used for the door or window frame.

According to the invention, this is achieved in that the insert member comprises a slideway being fixable with regard to the U-shaped rail etc., and the slide member accommodating the pivot pin is guided in such a manner that it is adjustable by means of a regulating screw.

According to the invention in an opposite way as according to to the prior art the mounting member comprising the bearing bushing is fixed at the door or window frame, and the mounting member comprising the insert member is fixed at the upper door or window pane rim in the U-shaped rail or the recess etc. Therefore, a bore within the door or window frame for accommodating the bearing bushing which is also on the outside cylindrical-shaped is enough and this bore can be formed by means of a hand drill without problems, where this mounting member is fixed by means of the fixing panel at the door or window frame. Moreover, mounting the door or window pane after mounting the mounting elements is also possible without problems since the pivot pin at first is retracted into the insert member and then can be drawn out of of the insert member and into the bearing bushing after aligning the door or window pane by means of the fixing screw and can then be fixed in the insert member by means of tightening the fixing screw. Such a fixation of the pivot pin in its drawn out position by means of a fixing screw which directly engages a pivot pin guarantees that it is additionally much simpler than the complicated lever mechanism of the prior art as described above.

For the reason that the pivot pin after it has been drawn out from the insert member is not only clamped by means of the fixing screw, but also locked form-fitted, that means positively locked, according to a preferred embodiment of the invention, on the level of the upper end of the elongated hole a crossing bore is provided on the other side of the pivot pin with regard to the elongated hole, and this crossing hole is adapted to accommodate the free end of the fixing screw. In other words, the pivot pin is accommodated in the insert member between the elongated hole and the crossing hole. Therefore, when the pivot pin is moved into its final position, the fixing screw abuts against the end of the elongated hole which is closed towards the bearing bushing and the fixing screw is therefore aligned with the bore so that the fixing screw which engages the threaded bore within the pivot pin can be screwed through until the free end of the fixing screw is inserted into the crossing bore and the screw can be tightened so as to be finally fixed in this position.

According to a preferred embodiment of the invention, there are also provided means for adjusting the pivot pin within the insert member along the rim of the door or window pane in a direction perpendicular to the longitudinal axis of said pivot pin. Therefore, the insert member is preferably provided with a slideway, in which a slide member accommodating the pivot pin is guided in such a manner that it can be adjusted by means of a regulating screw. By means of these measures adjusting the door or window pane is possible. Preferably, a slideway and the slide member are engaged with respect to each other in a dove-tail manner.

Although in the description above, only the upper door or window rim had been mentioned the mountings according to the invention may also be used at the bottom rim of the door or window.

In the following, the invention is elucidated by means of a preferred embodiment by referring to the drawings. In the drawings.

Figure 2:
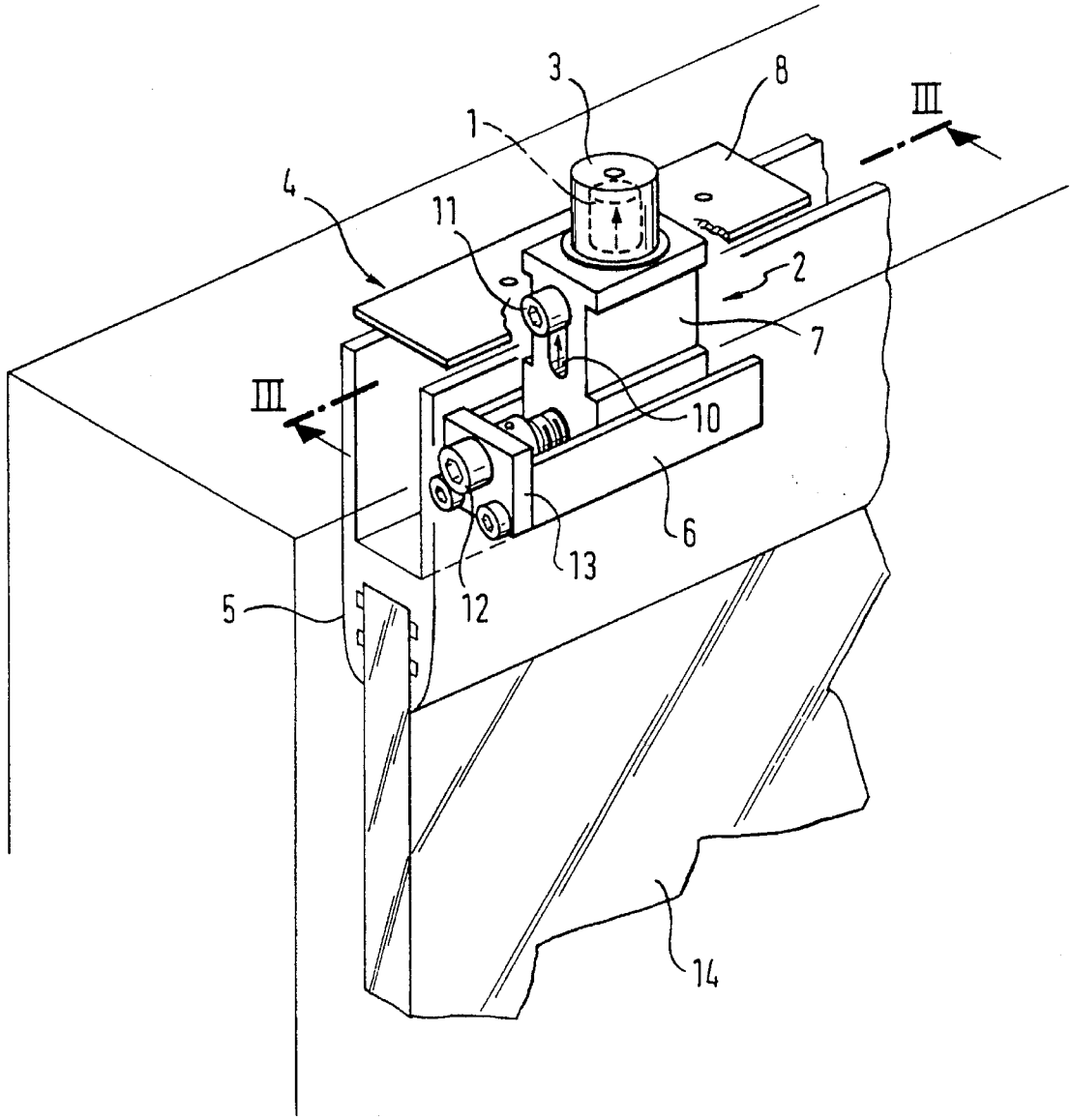
FIG. 2 shows schematically the state when the door pane is mounted into the door frame.

In the drawings, one embodiment of the invention shows the application of a frameless, hardened all-glass door, the glass pane 14 at the upper rim thereof being boarded by an H-shaped profile rail, which forms an U-rail 5 being open towards the upper side. Into the U-shaped rail 5, a first mounting member 2 of the door or window mountings according to the invention is inserted as an insert member, which has a slideway 6 being fixed by means of screws to the bottom of the U-shaped rail 5, said slideway 6 having a dovetail groove (compare reference sign 16 FIG. 4) extending in longitudinal direction of the U-shaped rail 5 and having a slide member 7 engaging said dovetail groove by means of its bottom part fitting into said dovetail groove. The slide member 7 being formed substantially like a rectangular prism is provided with a vertically extending receiving bore 9 with a pivot pin 1 being actually moveable accommodated therein, and the slide member further comprises an elongated hole 10 extending vertically along the pivot pin 1. Within the pivot pin 1, a threaded through bore (compare FIG. 3) is built extending perpendicular with respect to the axis of said pivot pin 1, and a fixing screw 11 being screwable through said elongated hole 10 into said threaded bore. After having screwed the fixing screw 11 into the pivot pin 1, it can be lifted by means of the fixing screw 11 in uptoward direction, so that the pivot pin then extends, as shown in FIG. 2, beyond the slide member 7 in upward direction. In this position of the pivot pin 1, the fixing screw 11 sits close to the upper end of the elongated hole 10 and is aligned with a crossing bore (compare reference sign 15 in FIG. 3) which is formed in the slide member 7 on the opposite side of the pivot pin 1, the free end of the fixing screw 11 entering said crossing bore 15 by screwing it further through the drawn out pivot pin 1 for locking it. By tightening the fixing screw 11 until the head thereof sits close to the slide member 7 on both sides of the elongated hole 10, the fixing screw is secured by frictional engagement.

The second mounting member 4 is provided with a bearing bushing 3 building a bearing for the pivot pin 1. At the bottom end of the bearing bushing 3 a fixing panel 8 is fixed, by means of which the second mounting member 4 is fastened with screws below the door frame, wherein the bearing bushing 3 is accommodated within a vertical bore having been bored previously into the door frame. For mounting the door pane it is positioned, with the pivot pin 1 being completely withdrawn into the slide member 7, under the bearing bushing 3 with the pivot pin being aligned therewith, whereafter the pivot pin 1 is drawn out of the slide member 7 in uptoward direction into the bearing bushing 3. The mounting procedure is then finished by locking the pivot pin 1 within the slide member 7.

The slideway 6 is further provided on the same side on which the elongated hole 10 is provided within the slide member 7 with a crossing front plate 13 rotatably bearing a regulating screw 12 extending in longitudinal direction of the U-shaped rail, said regulating screw engaging a threaded bore in the bottom part of the slide member 7. By rotating the regulating screw 12, the position of the slide member 7 can be adjusted for adjusting the position of the pivot pin 1 in longitudinal direction of the U-shaped rail 5.

Figure 3:
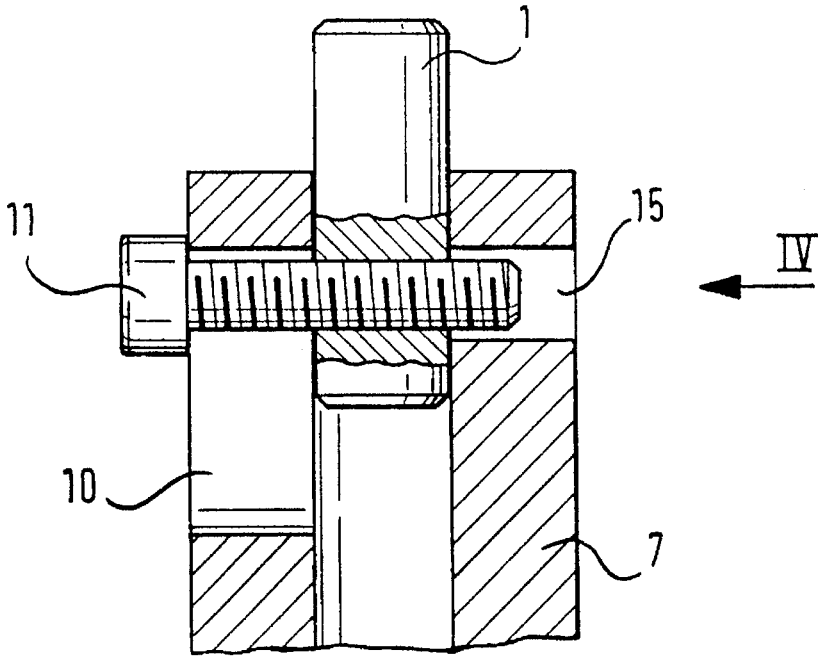
FIG. 3 shows a section of the slide member which is denoted "III—III" in FIG. 2.

FIG. 3 shows the section of the slide member 7 denoted III—III in FIG. 2 and shows the pivot pin 1 in its locked position. The pivot pin 1 is provided with a threaded bore through which the fixings screw 11 is screwed after having passed the elongated hole 10. The tip of the fixing screw 11 has entered the crossing bore 15 for positively locking the pivot pin 1 with regard to the slide member 7. Moreover, the head of the fixing screw 11 frictionally engages the slide member 7 on both sides of the elongated hole 10.

Figure 1:
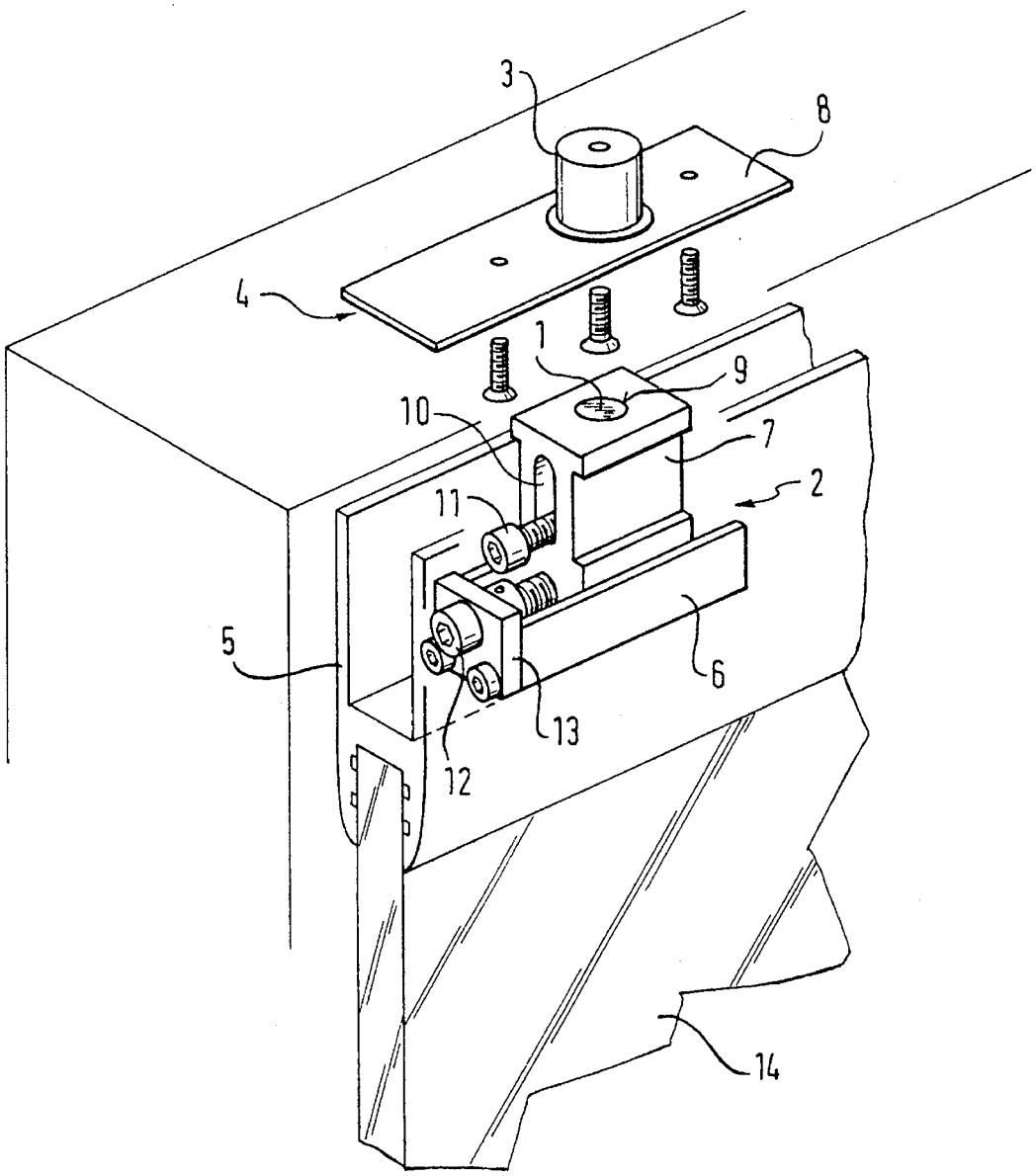
FIG. 1 shows the state of the door pane before having been mounted into the door frame.
Figure 4:
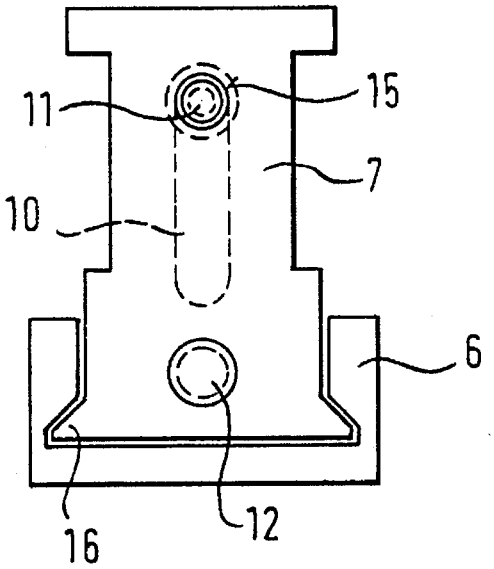
FIG. 4 shows a partial view showing one side of the slide member and the slideway schematically as denoted "IV" in FIG. 3.

FIG. 4 shows a rear view denoted "IV" in FIG. 3. Besides the elements shown in FIG. 3 also the slideway 6 is shown which is engaged by the slide member 7 by means of a dovetail guidance 16. By means of the adjusting screw 12 (also compare FIG. 1 and 2) the slide member 7 is adjustable with respect to the slideway 6 in longitudinal direction and therefore the position of the pivot pin 1 is adjustable in longitudinal direction of the U-shaped rail 5.

I claim:

1. A door or window mounting comprising a first mounting member (2) having a pivot pin (1), said first mounting member being formed as an insert member fixable within a U-shaped rail (5) or recess, a second mounting member (4) formed as a bearing bushing (3) with a fixing panel (8) on the side pointing in the direction of and accommodating the pivot pin (1), the pivot pin (1) being slidable in its axial direction within a receiving bore (9) in the insert member, the insert member including a side member (7) provided with a lateral elongated hole (10) along the pivot pin (1), a fixing screw (11) extending through said elongated hole (10) and screwed into the pivot pin (1) which is fixable with respect to the insert member by means of said fixing screw, the insert member including a slideway (6) fixable with respect to the U-shaped rail (5), the slide member (7) accommodating the pivot pin (1) and guided in a manner such that it is adjustable by means of a regulating screw (12), the side member (7) including a crossing bore (15) aligned with one end of the elongated hole (10) and disposed opposite the pivot pin (1), the crossing bore (15) extending perpendicular to the longitudinal axis of the pivot pin (1) and receiving the free end of the fixing screw (11).

2. A door or window mounting according to claim 1, wherein the slideway (6) and the slide member (7) mutually engage each other in a dovetail-like manner.

3. A door or window mounting comprising a first mounting member (2) having a pivot pin (1), said first mounting member being formed as an insert member fixable within a U-shaped rail (5) or recess, a second mounting member (4) formed as a bearing bushing (3) with a fixing panel (8) on the side pointing in the direction of and accommodating the pivot pin (1), the pivot pin (1) being slidable in its axial direction within a receiving bore (9) in the insert member, the insert member including a side member (7) provided with a lateral elongated hole (10) along the pivot pin (1), a fixing screw (11) extending through said elongated hole (10) and screwed into the pivot pin (1) which is fixable with respect to the insert member by means of said fixing screw, the insert member including a slideway (6) fixable with respect to the U-shaped rail (5), the slide member (7) accommodating the pivot pin (1) and guided in a manner such that it is adjustable by means of a regulating screw (12), the slideway (6) and the slide member (7) mutually engaging each other in a dovetail-like manner.

4. A door or window mounting according to claim 3 wherein the side member (7) includes a crossing bore (15) aligned with one end of the elongated hole (10) and disposed opposite the pivot pin (1), the crossing bore (15) extending perpendicular to the longitudinal axis of the pivot pin (1) and receiving the free end of the fixing screw (11).

* * * * *